United States Patent [19]

Moles

[11] Patent Number: 5,031,611

[45] Date of Patent: Jul. 16, 1991

[54] CUSTOMIZED SCUBA-DIVING MOUTHPIECE AND METHOD OF MANUFACTURE

[76] Inventor: Randall C. Moles, 107 12th St., Racine, Wis. 53403

[21] Appl. No.: 380,397

[22] Filed: Jul. 17, 1989

[51] Int. Cl.[5] ..... B63C 11/16; A61M 16/00; A62B 9/06

[52] U.S. Cl. ..... 128/201.11; 128/207.14

[58] Field of Search ..... 128/857, 859, 861, 862, 128/200.24, 200.26, 201.11, 201.26, 201.27, 206.29, 207.14, DIG. 26, 911, 912; 433/6, 215, 229

[56] References Cited

U.S. PATENT DOCUMENTS

| | | | |
|---|---|---|---|
| 2,678,043 | 5/1954 | Stark | 128/861 |
| 3,107,667 | 10/1963 | Moore | 128/136 |
| 3,844,281 | 10/1974 | Shamlian | 128/207.14 |
| 3,929,548 | 12/1975 | Shamlian | 156/245 |
| 3,993,060 | 11/1976 | Mitchell | 128/201.11 |
| 4,031,888 | 6/1977 | Walters | 128/201.11 |
| 4,066,077 | 1/1978 | Shamlian | 128/201.11 |
| 4,136,689 | 1/1979 | Shamlian | 128/147 |
| 4,230,106 | 10/1980 | Geeslin et al. | 128/201.11 |
| 4,516,938 | 5/1985 | Hall | 433/215 |
| 4,608,021 | 8/1986 | Barrett | 433/215 |
| 4,610,246 | 9/1986 | Delphia | 128/201.11 |
| 4,631,030 | 12/1986 | von Weissenfluh | 433/229 |
| 4,673,353 | 6/1987 | Nevin | 433/215 |
| 4,818,231 | 4/1989 | Steiner et al. | 433/215 |
| 4,836,782 | 6/1989 | Gonser | 433/215 |
| 4,860,739 | 8/1989 | Vandepol | 128/201.11 |

FOREIGN PATENT DOCUMENTS

| | | | |
|---|---|---|---|
| 422834 | 6/1947 | Italy | 128/207.14 |

*Primary Examiner*—Edgar S. Burr
*Assistant Examiner*—Kimberly L. Asher
*Attorney, Agent, or Firm*—Peter N. Jansson, Ltd.

[57] ABSTRACT

An improved customized scuba-diving mouthpiece has a base member with a front portion with breathing hole and two preferably apertured mount portions extending rearwardly for positions between the diver's teeth, and upper and lower bite members above and below each mount portion and joined together, preferably through the mount portions. Preferred features include upper and lower bite members form-set (cross-linked) together through the openings, the mount portions dimensioned to extend rearwardly between the molars to the rear of the mouth, and a configuration of mount portion and front portion facilitating buddy-breathing. A method for making such mouthpiece is also disclosed.

23 Claims, 2 Drawing Sheets

CUSTOMIZED SCUBA-DIVING MOUTHPIECE AND METHOD OF MANUFACTURE

FIELD OF THE INVENTION

This invention is related generally to scuba-diving mouthpieces and, more particularly, to mouthpieces of the type customized for individual divers.

BACKGROUND OF THE INVENTION

Scuba-diving mouthpieces of various kinds have been known and used for many years. The great majority of such mouthpieces are not customized for particular divers; however, some customized scuba-diving mouthpieces have been used or otherwise disclosed. Examples of customized scuba-diving mouthpieces are those shown in U.S. Pat. Nos. 3,107,667 (Moore), 3,844,281, 3,929,548, and 4,136,689 (Shamlian).

Despite advances made in recent years, there are a number of problems and shortcomings with scuba-diving mouthpieces of the prior art, including customized mouthpieces. One problem relates to the mouth fatigue which is fairly common to scuba divers. Mouthpieces are typically held in place by means of the diver's bite on retaining members which project inwardly from a lip-engaging portion to between the diver's upper and lower teeth. This places significant pressures on small portions of the diver's teeth, that is, the portions engaging the retaining members.

Customizing the surfaces of such retaining members to match the tooth surfaces, as in the above-mentioned Shamlian patents, ameliorates the problem to some extent. However, the improvement is quite limited because of the fact that contact with the inwardly-projecting retaining members is limited to only a few teeth.

Greater tooth contact is possible with customized scuba-diving mouthpieces such as that disclosed in the above-mentioned Moore patent. In such patent, the tooth-engaging portions extend well back along the line of molars on either side of the mouth. Such extension provides a greater lever arm, thereby reducing the pressure necessary to hold the mouthpiece in the mouth. Because of this, mouth fatigue should be reduced.

However, the process used to manufacture such mouthpiece is extremely complex, requiring steps such as making wax replicas of the maxillary impression and mandibular impression of the mouth, mounting replicas in relative positions of the partly-opened mouth, carving, uniting tube and tooth impression portions, plaster forming, introducing vulcanizable rubber, separating of plaster from formed rubber, etc.

The complexity of this process rules out quick preparation, such as in a diving equipment shop. Furthermore, it can produce mouthpieces which are less than satisfactory in comfort. In some cases, this is because the relative positions of the relative maxillary and mandibular portions may not be natural. In other cases, this may be because the relative positions are not sufficiently closed. The problem of unnatural jaw position placement is accentuated for the approximately 20% of the population whose jaws are developed well away from normal patterns. In each case, improper relative placement, even in customized scuba-diving mouthpieces, exacerbates the usual problems of jaw fatigue.

Another problem with certain customized scuba-diving mouthpieces of the prior art, particularly those using the diver's teeth to form the final impression on the custom formed portion of the mouthpiece, is that a preliminary heating step is required before forming. This tends to complicate the formation steps and raises a risk of mouth burns, particularly if the process is carried out in a diving shop.

Still another problem with customized scuba-diving mouthpiece formation, particularly in those situations in which the diver's teeth directly form the final impression on the custom formed portion of the mouthpiece, is the unfortunate tendency of some people, during molding procedures, not to bite with their jaws in natural relative positions. In such cases, many people make their lower jaws protrude too far forward, with possible result that the final product will not accommodate the most natural relative jaw positions.

Still another problem with prior customized scuba-diving mouthpieces of the prior art is that such mouthpieces do not very well accommodate what is referred to by divers as "buddy-breathing." Buddy-breathing involves use of a single mouthpiece by more than one diver, as may be necessary when the oxygen supply of one diver is low. In such situations, the mouthpiece is handed back and forth for alternating use by two divers. Customized mouthpieces of the prior art are not well suited for this practice. Indeed, this is particularly true for mouthpieces having extended tooth engagement along either side of the diver's mouth.

There is a clear need for significant improvements in customized scuba-diving mouthpieces.

OBJECTS OF THE INVENTION

It is an object of this invention to provide an improved customized scuba-diving mouthpiece which overcomes some of the problems and shortcomings of the prior art.

Another object of this invention is to provide an improved manufacturing method for customized scuba-diving mouthpieces.

Another object of this invention is to provide an improved scuba-diving mouthpiece which minimizes or eliminates diver fatigue of the type associated with holding the mouthpieces.

Another object of this invention is to provide an improved customized scuba-diving mouthpiece of the type with substantial tooth-engaging contact to minimize pressures.

Another object of this invention is to provide an improved mouthpiece of the type just mentioned which may be made using a simplified manufacturing method.

Another object of this invention is to provide an improved manufacturing method for customized scuba-diving mouthpieces which can be easily and safely practiced in diving equipment shops and the like.

Another object of this invention is to provide an improved mouthpiece which has natural relative positions of the maxillary and mandibular customized surfaces.

Another object of this invention is to provide an improved manufacturing method and resulting customized mouthpiece providing particular comfort to those divers having jaws and jaw positions which are well away from normal patterns.

Another object of this invention is to provide an improved manufacturing method which is quick and safe.

Another object of this invention is to provide an improved customized mouthpiece manufacturing method which eliminates a preliminary heating step.

Another object of this invention is to provide an improved customized mouthpiece manufacturing method which overcomes the tendency of some people, during molding procedures, to bite with their jaws in unnatural relative positions, such as with their lower jaws protruding too far forward.

Another object of this invention is to provide an improved customized mouthpiece with improved accommodation of "buddy-breathing."

These and other important objects will be apparent from the descriptions of this invention which follow.

SUMMARY OF THE INVENTION

This invention is an improvement in scuba-diving mouthpieces and, more specifically, an improved customized scuba-diving mouthpiece of the type including a front portion forming a breathing hole and rear portions customized for a diver. This invention also involves an improved method for making such customized mouthpieces. The mouthpiece and method of this invention overcome certain problems and shortcomings of the prior art, including those mentioned above.

The mouthpiece of this invention includes a base member having the mouthpiece front portion and also having a pair of mount portions extending rearwardly from such front portion for positions between the diver's teeth. The mount portions preferably have openings through them. The mouthpiece of this invention also includes an upper bite member and a lower bite member respectively above and below each mount portion. Such upper and lower bite members are joined together about and preferably through the mount portions. The bite members have the diver's dental impressions formed in them.

Each of the mount portions has an upper surface and a lower surface and a surrounding lateral edge. Such upper and lower surfaces are in contact with the upper and lower bite members, respectively. The upper and lower bite members and the mount portion with which they are engaged form members which may comfortably be engaged by the diver's teeth. Each of the mount portions preferably is dimensioned to extend rearwardly between the molars of the diver to the rear of the mouth; this achieves a full and comfortable customized mouth engagement.

The upper and lower bite members are preferably firmly joined together by the form-setting process, used in manufacturing the device of this invention. That is, the upper and lower bite members are preferably joined by polymer cross-linking of/within the material which forms them. Preferably such intimate joining occurs through the preferred openings, as mentioned above.

In certain embodiments, each mount portion of the base member has a plurality of the aforesaid openings, such openings being spaced across each mount portion. In some embodiments a slot extends through the mount portions and is aligned in a fore-and-aft direction. A wide variety of openings may be used.

In certain embodiments, the openings in the mount portions extend to the lateral edge of the mount portions and are open thereto in a lateral direction. This facilitates removal of the joined upper and lower bite members from the mount portions so that the base member can be reused with new upper and lower bite members.

In certain highly preferred embodiments, the front portion of the base member has a substantially vertical rear wall which includes a pair of laterally-extending portions which extend to the mount portions, and each mount portion has a forward edge joining one of the laterally-extending portions at a position spaced from the hole. With this feature, the bite members and the mount portion with which they are joined may readily be bent away from the rear wall of the front portion of the base member. Such bending away facilitates buddy-breathing.

In such preferred configurations, the outer portion of the mount portion lateral edge, that is, the portion of the mount portion lateral edge which is against the inside of the diver's cheek, is most preferably in alignment with one of the laterally-extending portions of the rear wall of the base-member front portion, and the forward edge of the mount portion has a major portion extending inwardly therefrom free of contact with the base-member front portion. This facilitates bending for buddy-breathing.

The base member described above, which is used for simplified manufacture of a customized scuba-diving mouthpiece is itself another aspect of this invention. Another aspect of this invention is the improved method used for making customized scuba-diving mouthpieces like those just described. This improved method has important advantages over methods of manufacture previously in use.

The improved method of this invention includes the following steps: providing a preformed base member of the type described above; applying moldable upper and lower bite members to (e.g., above and below) each of the mount portions of such base member to provide an unmolded assembly; placing the unmolded assembly in the mouth of the diver with the mount portions and bite members thereon positioned between the diver's teeth; biting on the bite members to mold the bite members and to press them together, preferably through the preferred openings in the mount portions; removing the assembly from the diver's mouth; and form-setting the molded bite members while on the base member mount portions by application of energy thereto for polymer cross-linking.

The bite members are made of materials which are moldable at fairly low temperatures acceptable to oral tissues. For certain materials a pre-molding heating step is necessary, and this may be carried out by dipping the bite members in hot water for a short time, which may be followed by plunging into cold water just prior to placement within the mouth. The form-setting step preferably includes setting (that is, cross-linking) each pair of upper and lower bite members together to firmly connect them to each other and thus firmly attach them to the mount portion of the base member.

In highly preferred practices, in which the front portion of the base member has a substantially vertical rear wall, the step involving placing this structure in the mouth of the diver includes inserting a removable bite-limiting plug into the breathing hole to a position such that it extends rearwardly from the rear wall to a position which would be between the diver's upper and lower teeth. In such cases, the biting step includes biting until the upper and lower teeth engage such inserted plug. This controls the degree of bite and the depth of tooth impressions in the bite members.

In such procedures, it is most preferred that such plug have a gauge means on its lower surface. Such gauge means is preferably a slot extending from side to side such that it can be engaged by the diver's lower teeth. Such slot or other gauge means is positioned sufficiently to the rear such that in place it can be rearward of the rear wall of the base member front portion. The insertion of the plug is carried out before the bite members are applied to the mount portions, and then a particular alignment procedure is followed before the bite members are applied to the mount portions.

Such preferred alignment procedure includes first moving the base member with the plug in it into the diver's mouth until the rear wall is against the diver's upper incisors, and then adjusting the relative positions of the diver's upper and lower jaws until they assume the most natural relative positions. Then, the fore-and-aft position of the plug with respect to the base member is adjusted until the lower teeth engage the aforementioned slot or other gauge means on the lower surface of the plug. Then, the relative fore-and-aft position of the plug is maintained through the remaining procedures, at least through the biting step.

The biting step is carried out with the front teeth in contact with the rear wall of the base member front portion and the lower teeth engaging the gauge means. This causes the tooth impressions to be formed on the bite members in positions which cause the diver's mouth and jaw muscles to be most comfortable during diving. In other words, mouthpiece comfort in use is enhanced even more significantly.

DETAILED DESCRIPTIONS OF PREFERRED EMBODIMENTS

Figure 2:
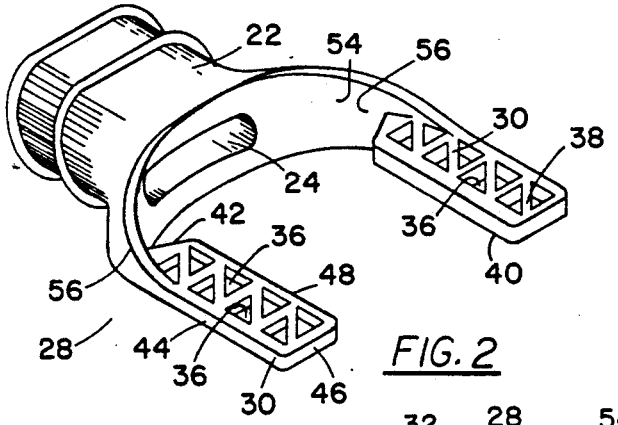
FIG. 2 is a perspective view of a scuba-diving mouthpiece base member used in making the mouthpiece.

The drawings illustrate a scuba-diving mouthpiece 20 according to a preferred embodiment of this invention, and fragmentary views of alternate embodiments. Mouthpiece 20 has a front portion 22 forming a breathing hole 24, and rear portions 26 customized for a particular diver.

More specifically, mouthpiece 20 is formed of a base member 28 and, on each side, bite members 32 and 34. Base member 28 includes front portion 22, which forms the breathing hole, and a pair of mount portions 30 which extend rearwardly from front portion 22 to positions extending between the divers molars. An upper bite member 32 and a lower bite member 34 are, respectively, above and below each mount portion 30.

In the preferred embodiment shown in FIGS. 1–7 and 10, mount portions 30 are generally flat members which define a plurality of triangular openings 36 spaced thereacross. Each mount portion 30 has horizontal upper and lower surfaces 38 and 40 which are parallel and a surrounding edge which includes a forward edge 42, an outer lateral edge 44, a rear edge 46, and an inner lateral edge 48.

Upper and lower bite members 32 and 34 are, in each case, above and below mount portion 30. Upper and lower bite members are form-set together through openings 36 of mount portions 30, and thus form with mount portion 30 a firmly-connected structure. Bite members 32 and 34 have the diver's dental impressions in them.

Each mount portion 30 is dimensioned to extend rearwardly from front portion 22 between the diver's molars all the way to the rear of the mouth, or very close thereto. This provides sufficient tooth engagement, particularly with the customized bite surfaces, such that little effort is required to hold mouthpiece 20 in place during scuba diving.

Figure 8:
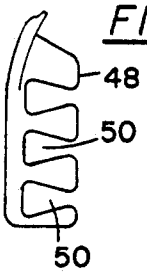
FIG. 8 is a fragmentary top plan view of an alternative base member.
Figure 9:
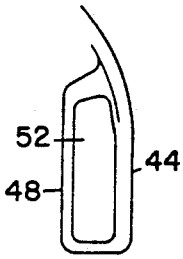
FIG. 9 is a fragmentary top plan view of still another base member.

FIGS. 8 and 9 illustrate alternate embodiments of the invention, the only differences, however, relating to the nature of the openings in the mount portions of base member 28. FIG. 8 shows openings 50 which extend to inner lateral edge 48 and open toward the inside. With this feature, upper and lower bite members which have been well connected together through openings 50 can be pulled away from the mount portion by movement across inner lateral edge 48. This would allow the base member to be used again with a new set of upper and lower bite members. FIG. 9 shows a single slot 52 extending in the mount portion in a fore-and-aft direction.

Front portion 22 of base member 28 has a vertical rear wall 54 which includes a pair of laterally-extending portions 56. Laterally-extending portions 56 extend outwardly to mount portions 30. For each mount portion 30, forward edge 42 joins one of laterally-extending portions 56 at a position spaced from breathing hole 24. This facilitates bending of mount portions 30 with bite members 32 and 34 thereon away from rear wall 54 to facilitate buddy-breathing. The fact that the bit members do not extend around the front is helpful in such bending.

Outer lateral edge 44 of each mount portion 30 is in alignment with the laterally-extending portion 56 to which it is attached. That is, a continuation of the curve along which laterally-extending portion 56 extends is in alignment outer lateral edge portion 44. Forward edge 42 has a major portion 42A which extends inwardly from laterally-extending portion 56 free of contact with base-member front portion 22. This further facilitates bending for buddy-breathing.

Scuba-diving mouthpiece 20 may be made in a diving supply shop or the like by individuals with minimal training. Laboratory conditions and personnel are not essential. A number of simple steps are used.

In preferred embodiments, only simple steps are necessary for preheating the bite members before dental impressions are made. In some cases, with appropriate formulation of material for the bite members, it may be possible to eliminate completely the preheating step. In any event, after impressions are formed in bite members 32 and 34, they will be form-set by appropriate application of energy for polymer cross-linking, such that they take the molded shape permanently. Such form-setting step may be by short-term application of UV energy to mouthpiece 20 in a simple counter-top UV curing mechanism. Energy may be applied in other ways for this purpose. This form-setting step is the final step in manufacture of the mouthpiece of this invention.

The manufacturing method of this invention is now described in greater detail:

The first step in the method of this invention is providing a preformed base member 28 of the type already described. Base member 28 is preferably made of an orally acceptable material which is pliable and resiliently flexible. Suitable materials include silicone rubber, plasticized polyvinyl chloride, and certain ethylene vinyl acetates. A wide variety of materials are acceptable.

Figure 5:
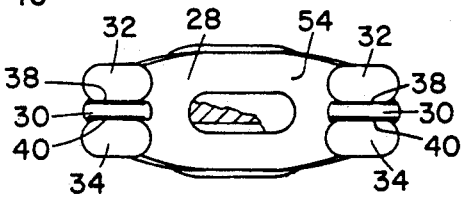
FIG. 5 is a rear elevation of the mouthpiece of FIG. 4 at the same point during formation, with the bite-limiting plug in partial breakaway to show a slot on the lower surface thereof.
Figure 3:
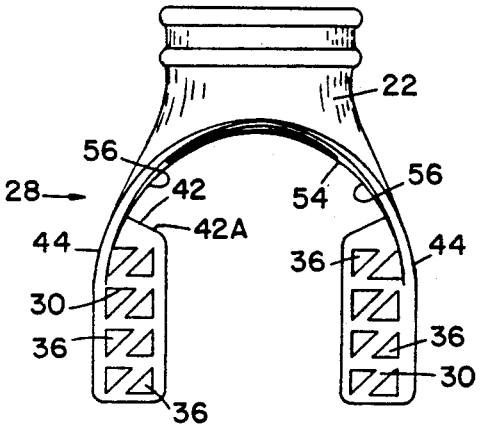
FIG. 3 is a top plan view of FIG. 2.
Figure 6:
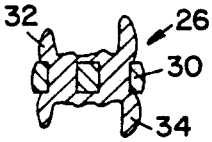
FIG. 6 is a sectional view taken along section 6—6 as indicated in FIG. 1.
Figure 4:
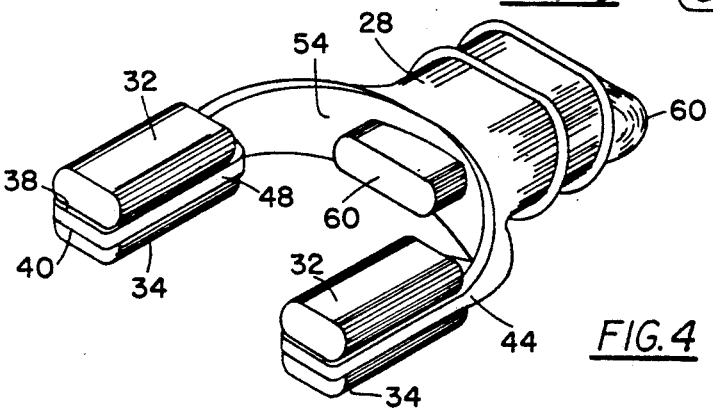
FIG. 4 is a perspective view of the mouthpiece of this invention during formation, with four bite-member blanks in place for custom formation and a bite-limiting plug in place.
Figure 1:
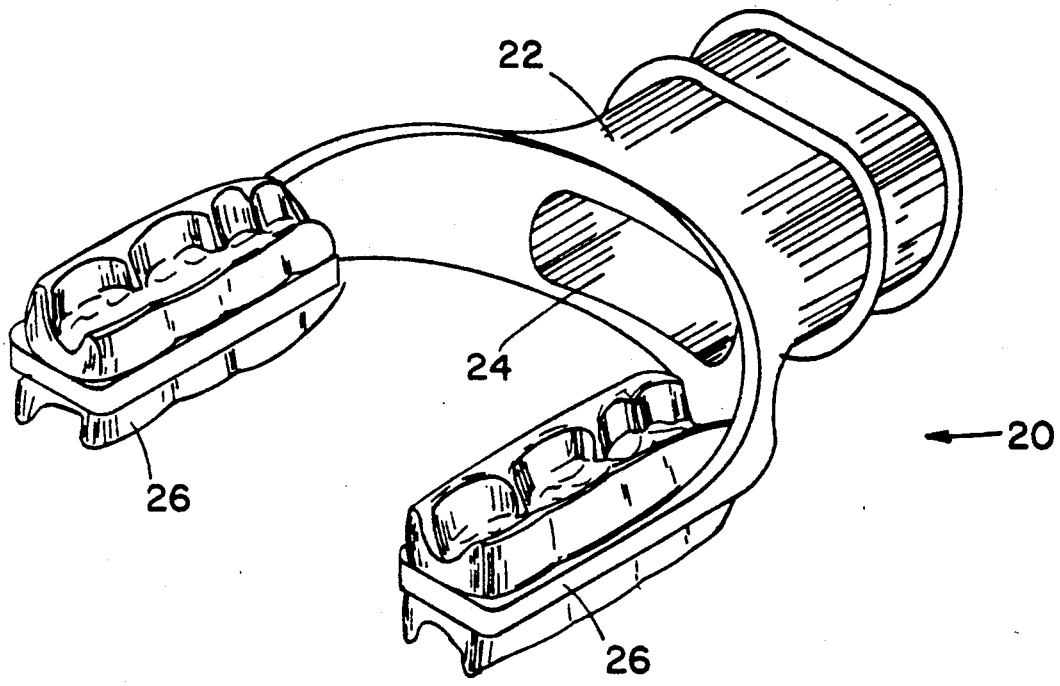
FIG. 1 is an enlarged perspective view of a customized scuba-diving mouthpiece in accordance with this invention.
Figure 10:
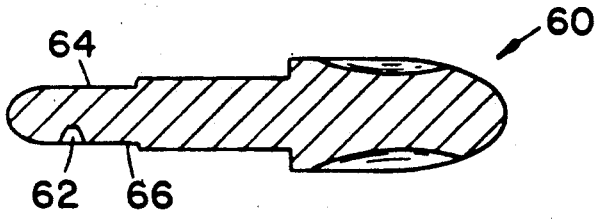
FIG. 10 is a side sectional view of the bite-limiting plug shown in FIGS. 4 and 5.

The next step is to apply moldable upper and lower bite members 32 and 34 in an unformed condition, as shown in FIGS. 4–6, to above and below each mount portion 30 to provide an unmolded assembly. Unformed upper and lower bite members 32 and 34 may be gently pressed against mount portions 30 such that they adhere to it; or, they may be pressed enough such that they extend well into openings 36 and even into contact with one another.

Before molding, unformed bite members 32 and 34 must be put into condition for molding. Appropriate steps for this purpose will depend, of course, on the material used for bite members 32 and 34. Acceptable materials include certain ethylene vinyl acetates (EVAs). EVAs having appropriate material qualities are widely available from various sources, in various standard formulations, or may be specially formulated to achieve the desired qualities.

One preferred EVA is ELVAX 250, available from DuPont Company, Wilmington, Del. ELVAX 250, which has 28% vinyl acetate, has a softening point of 108 degrees F. Suitable EVAs are also available from Exxon Corporation (under Exxon's trademark ESCORENE) and from Quantum Company (under Quantum's trademark ULTRATHENE).

Bite members made of ELVAX 250 or other similar material may be dipped into hot water for about 30 seconds and then plunged into cold water for about a second to remove some of the surface heat. These preheating steps can be carried out either before placement on mounting portions 30 or after such placement. If carried out after such placement, the dipping steps, of course, involve base member 28 as well as the bite members thereon. Preheating can be carried out in other ways, but the dipping process is simple to carry out in a diving supply shop.

After placement of the unformed bite members on the mount portions and any necessary preheating, the method of this invention includes placing the unmolded assembly in the mouth of the diver with the mount portions and bite members thereon positioned between the diver's teeth, then biting on such bite members to mold said bite members and press them together, preferably through the preferred openings in the mount portions, then removing the assembly from the diver's mouth, and finally form-setting the molded bite members while on the base member mount portions by application of energy for cross-linking.

The form-setting/cross-linking step may be carried out by placement of the base member and molded bite members thereon into a UV curing mechanism and applying UV energy as necessary. Energy for such form-setting can be applied in other ways as well.

In certain embodiments, both base member 28 and bite members 32 and 34 may be made of EVA. For example, base member 28 could be made of an EVA, perhaps an EVA with lower vinyl acetate content (perhaps on the order of 10–20%) than the preferred EVA (ELVAX 250) mentioned above. While base member 28 would have been preformed, some polymer cross-linking between the bite members and base member 28 could still occur during the final form-setting step described above. This would provide an even stronger link between bite members and base member than the mechanical bond alone provides.

In highly preferred embodiments, the placing step includes use of a removable bite-limiting plug 60. Plug 60 serves to limit and define the extent of the biting motion during formation of the customized mouthpiece of this invention. Plug 60 is made of hard material and has an upper surface 64 and a lower surface 66 which are spaced from one another by a distance corresponding to an appropriate degree of openness of the mouth for scuba diving. Lower surface 66 has a groove 62 therein extending in a side-to-side direction. Groove 62 is of sufficient size to receive a diver's lower teeth during the manufacture of the customized mouthpiece of this invention.

Plug 60 is used by inserting it into breathing hole 24 to a position such that it extends rearwardly from the rear wall to a position which would be between the diver's upper and lower teeth. The biting step then includes biting until the upper and lower teeth engage plug 60, which limits the degree of bite into bite members 32 and 34. Thus, the depth of tooth impressions are controlled.

Insertion of plug 60 is preferably before bite members 32 and 34 are applied to mount portions 30. The most preferred form of the method of this invention includes an alignment procedure before bite members 32 and 34 are applied to mount portions 30.

Such alignment procedure includes moving base member 28 with plug 60 inserted therein into the diver's mouth until rear wall 54 is against the diver's upper incisors. Then, the relative positions of the diver's upper and lower jaws are adjusted until in they are in their most natural and comfortable condition. After that, the position of plug 60 with respect to the base member is adjusted in a fore-and-aft direction until the lower teeth engage gauge groove 62 on lower surface 66. During such adjustment, rear wall 54 is kept against the diver's upper incisors.

While base member 28 and plug 60 therein are then removed from the mouth for placement of bite members 32 and 34 on mount portions 30, it is necessary to maintain the relative fore-and-aft position of plug 60 with respect to base member 28, and to maintain it through the biting step which follows. The biting step is then carried out with the front teeth contacting the rear wall and the lower teeth engaging the gauge means. This procedure is very easy to follow and provides enhanced comfort during later use of the customized mouthpiece.

This invention provides customized tooth-engagement members which extend along each side of the diver's mouth. The mouthpiece allows intimate tooth contact along the full extent of the diver's molars from the rear of the mouth to terminate near the front molars, such intimate contact extending along the full line of molars while the diver's mouth is in a relaxed, partially-opened position. This facilitates breathing and elimination of diver fatigue, and allows confidence about retention of the mouthpiece even with a relaxed jaw.

Figure 7:
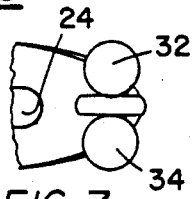
FIG. 7 is a fragmentary rear elevation of another mouthpiece of this invention during its formation, using alternative bite-member blanks.

As may be seen in FIGS. 4 and 5, unformed bite members 32 and 34 are preferably generally oval in cross-section. However, a wide variety of alternate shapes, such as the round cross-section of FIG. 7, are acceptable.

While the principles of this invention have been described in connection with specific embodiments, it should be understood clearly that these descriptions are made only by way of example and are not intended to limit the scope of the invention.

I claim:

1. In a scuba-diving mouthpiece of the type with a front portion forming a breathing hole and rear portions customized for a diver, the improvement comprising:

a base member including the front portion and a pair of mount portions extending rearwardly therefrom for positions between the diver's teeth; and separate upper and lower bite members respectively above and below each mount portion and joined together, the bite members having the diver's dental impressions therein, said upper and lower bite members and the mount portion therebetween initially being three separate members subsequently joined together to form a major customized tooth engagement member for the teeth on each side of the diver's mouth, said customized tooth engagement member extending along, and providing intimate tooth contact along, substantially the full extent of the diver's molars from the rear of the mouth to terminate near the front molars, such intimate contact being provided while the diver's mouth is in a relaxed, partially-opened position, thereby to eliminate diver fatigue.

2. In a scuba-diving mouthpiece of the type with a front portion forming a breathing hole and rear portions customized for a diver, the improvement comprising:

a base member including the front portion and a pair of mount portions extending rearwardly therefrom for positions between the diver'teeth, the mount portions defining engagement means thereon; and separate upper and lower bite members respectively above and below each mount portion and joined to said engagement means on the mount portions, the bite members having the diver's dental impressions therein, said upper and lower bite members and the mount portion therebetween initially being three separate members subsequently joined together to form a major customized tooth engagement member for the teeth on each side of the diver's mouth, said customized tooth engagement member extending along, and providing intimate tooth contact along, substantially the full extent of the diver'molars from the rear of the mouth to terminate near the front molars, such intimate contact being provide while the diver's mouth is in a relaxed, partially-opened position, thereby to eliminate diver fatigue.

3. A scuba-diving mouthpiece base member having a front portion forming a breathing hole and a pair of mount portions extending rearwardly therefrom for positions between the diver's teeth, the mount portions each having upper and lower surfaces and defining at least one opening therethrough extending between said upper and lower surfaces, said mount portion opening for mounting upper and lower bite members to such mount portion, each of the mount portions being dimensioned to extend rearwardly between the molars of the diver to the rear of the mouth, thereby to support bite members in major extended intimate customized tooth engagement along substantially the full extent of the diver's molars, on each side of the diver's mouth, extending from the rear of the mouth and terminating near the front molars to eliminate diver fatigue, such intimate contact being provided while the diver's mouth is in a relaxed, partially-opened position.

4. The scuba-diving mouthpiece base member of claim 3 wherein:

each of the mount portions has upper and lower surfaces and a lateral edge therearound; and said upper and lower surfaces are closely spaced whereby upper and lower bite members can be secured thereagainst, respectively.

5. The scuba-diving mouthpiece base member of claim 4 wherein the openings extend to the lateral edge and are open thereto, thereby facilitating removal of bite members therefrom so that the base member can be reused with new bite members.

6. The scuba-diving mouthpiece base member of claim 4 wherein each mount portion has a slot therein extending in a fore-and aft direction.

7. A scuba-diving mouthpiece base member having a front portion forming a breathing hole and a pair of mount portions extending rearwardly therefrom for positions between the diver's teeth, the front portion of the base member having a substantially vertical rear wall including a pair of laterally-extending portions which extend to the mount portions, the mount portions each having upper and lower surfaces and defining at least one opening therethrough extending between said upper and lower surfaces, each of the mount portions having a forward edge joining one of the laterally-extending portions at a position spaced from the hole, said mount portion opening comprising a slot extending in a fore-and-aft direction and serving for mounting upper and lower bite members to such mount portion, whereby the customized bite members may readily to bent away from the rear wall of the front portion of the base member to facilitate buddy-breathing.

8. The scuba-diving mouthpiece base member of claim 7 wherein for each mount portion:

the lateral edge includes a outer portion, said lateral edge outer portion being in alignment with the laterally-extending portions of the rear wall of the base-member front portion; and the forward edge has a major portion extending inwardly therefrom free of contact with the base-member front portion, thereby facilitating said bending for buddy-breathing.

9. A method for making a scuba-diving mouthpiece of the type having a front portion with a breathing hole and custom-molded rear portions engageable by a diver's teeth comprising:

providing a preformed base member which includes the front portion and a pair of mount portions extending rearwardly therefrom for positions between the diver'teeth;

applying moldable upper and lower bite members above and below each of the mount portions to provide and unmolded assembly;

placing the unmolded assembly in the mouth of the diver with the mount portions and bite members thereon positioned between the diver's teeth; biting on the bite members to mold said biter members and press them together;

removing the assembly from the diver's mouth; and form-setting the molded bite members while on the base member mount portions by application of energy for cross-linking.

10. The method of claim 9 wherein said mount portions have openings therethrough and wherein said biting step includes pressing the upper and lower bite members together through the openings in the mount portions.

11. The method of claim 9 wherein the form-setting step includes cross-linking between each pair of said upper and lower bite members together.

12. The method of claim 9 wherein the front portion includes a substantially vertical rear wall and:

the placing step includes inserting a removable bite-limiting plug into the breathing hole to a position such that it extends rearwardly from the rear wall to a position which would be between the diver's upper and lower teeth; and the biting step includes biting until the upper and lower teeth engage the plug, whereby the degree of bite and depth of tooth impressions are controlled.

13. The method of claim 12 wherein insertion of the plug is before the bite members are applied to the mount portions, and further including an alignment procedure before the bite members are applied to the mount portions, said alignment procedure comprising:

moving the base member with the plug inserted into the diver's mouth until the rear wall is against the diver's upper incisors;

adjusting relative positions of the diver's upper and lower jaws until in natural positions; and adjusting the fore-and-aft position of the plug with respect to the base member until the lower teeth engage gauge means on a lower surface of the plug rearward of the rear wall; and thereafter maintaining such fore-and-aft position of the plug through said biting step; and carrying out such biting step with the front teeth contacting the rear wall and the lower teeth engaging the gauge means.

whereby mouthpiece comfort in use is enhanced.

14. The method of claim 13 wherein the gauge means is a tooth-engaging groove.

15. In a scuba-diving mouthpiece of the type with a front portion forming a breathing hole and rear portions customized for a diver, the improvement comprising:

a base member including the front portion and a pair of mount portions extending rearwardly therefrom for positions between the diver's teeth;

an upper bite member and a lower bite member respectively above and below each mount portion and joined together, the bite members having the diver's dental impressions therein; and each mount portion having at least one opening therethrough, the upper and lower bite members thereon being joined together through said at least one opening.

16. The scuba-diving mouthpiece of claim 15 wherein each of the mount portions has a plurality of said openings spaced thereacross.

17. In a scuba-diving mouthpiece of the type with a front portion forming a breathing hole and rear portions customized for a diver, the improvement comprising:

a base member including the front portion and a pair of mount portions extending rearwardly therefrom for positions between the diver's teeth, each mount portion having an upper surface and a lower surface, a lateral edge therearound, and at least one opening through such mount portion, and being dimensioned to extend rearwardly between the molars of the diver to the rear of the mouth; and an upper bite member and a lower bite member in contact with the upper and lower surfaces, respectively, of each mount portion, said upper and lower bite members being joined together and having the diver's dental impressions therein, whereby a full and comfortable customized mouth engagement is achieved.

18. The scuba-diving mouthpiece of claim 17 wherein each of the mount portions has a plurality of said openings spaced thereacross.

19. The scuba-diving mouthpiece of claim 17 wherein the openings extend to the lateral edge and are open thereto, thereby facilitating removal of the joined upper and lower bite members from the mount portions so that the base member can be reused with new upper and lower bite members.

20. The scuba-diving mouthpiece of claim 17 wherein each mount portion has a slot extending therein extending in a fore-and-aft direction.

21. The scuba-diving mouthpiece of claim 17 wherein:

the front portion of the base member has a substantially vertical rear wall which includes a pair of laterally-extending portions which extend to the mount portions; and each of the mount portions has a forward edge joining one of the laterally-extending portions at a position spaced from the hole, whereby the customized bite members may readily be bent away from the rear wall of the front portion of the base member to facilitate buddy-breathing.

22. The scuba-diving mouthpiece of claim 21 wherein for each mount portion:

the lateral edge includes a outer portion, said lateral edge outer portion being in alignment with the laterally-extending portions of the rear wall of the base-member front portion; and the forward edge has a major portion extending inwardly therefrom free of contact with the base-member front portion, thereby facilitating said bending for buddy-breathing.

23. A scuba-diving mouthpiece base member having a front portion forming a breathing hole and a pair of mount portions extending rearwardly therefrom for positions between the diver's teeth, the mount portions each defining a plurality of openings therethrough for mounting thereto of upper and lower bite members.

* * * * *